United States Patent [19]

Iwata

[11] Patent Number: 4,739,743

[45] Date of Patent: Apr. 26, 1988

[54] IGNITION CONTROL SYSTEM FOR INTERNAL COMBUSTION ENGINE

[75] Inventor: Toshio Iwata, Hyogo, Japan

[73] Assignee: Mitsubishi Denki Kabushiki Kaisha, Tokyo, Japan

[21] Appl. No.: 7,237

[22] Filed: Jan. 27, 1987

[30] Foreign Application Priority Data

Jan. 28, 1986 [JP] Japan ..... 61-18459

[51] Int. Cl.[4] ..... F02P 3/04

[52] U.S. Cl. ..... 123/609; 123/610; 123/644

[58] Field of Search ..... 123/609, 610, 644

[56] References Cited

U.S. PATENT DOCUMENTS

| | | | |
|---|---|---|---|
| 4,351,287 | 9/1982 | Shirusaki et al. | 123/609 |
| 4,402,299 | 9/1983 | Nakao et al. | 123/644 |
| 4,495,931 | 1/1985 | Krauter et al. | 123/644 |
| 4,538,585 | 9/1985 | Arguevo et al. | 123/609 |
| 4,552,118 | 11/1985 | Fukaya | 123/609 |
| 4,638,785 | 1/1987 | Matsui et al. | 123/644 |
| 4,649,888 | 3/1987 | Kawai et al. | 123/644 |

*Primary Examiner*—Raymond A. Nelli

*Attorney, Agent, or Firm*—Sughrue, Mion, Zinn, Macpeak and Seas

[57] ABSTRACT

An ignition control system for an internal combustion engine has means for determining the maximum energizing time of an ignition coil from a signal synchronized with the ignition timing of the engine and controlling the period that the energizing current reaches a predetermined value to a predetermined value, thereby determining the maximum energizing time of the ignition coil from the signal synchronized with the ignition timing of the engine, detecting the energizing current of the ignition coil, and variably setting the maximum closed-circuit rate of energizing the ignition coil according to the operating state of the engine and a battery voltage.

7 Claims, 3 Drawing Sheets

IGNITION CONTROL SYSTEM FOR INTERNAL COMBUSTION ENGINE

BACKGROUND OF THE INVENTION

The present invention relates to an ignition control system for an internal combustion engine adapted to vary the maximum closed-circuit rate characteristic of an ignition coil according to the engine speed or the power source voltage.

An induction discharge type igniter used for an internal combustion engine flows a current in the primary side winding of an ignition coil, and generates a high voltage energy in the secondary side winding of the ignition coil by interrupting the current, to thereby discharge a spark ignition plug connected to the secondary side winding of the ignition coil.

The high voltage energy in the secondary side winding of the ignition coil generally has a relation to a current (hereunder referred to as "an interrupting current") when the primary side winding of the ignition coil is broken. Therefore, in order to produce an energy necessary to ignite an internal combustion engine, it is necessary to energize the primary side winding of the ignition coil until the interrupting current reaches a value necessary to ignite.

The energizing time of the ignition coil until the interrupting current reaches a predetermined value depends upon the battery voltage, the primary side inductance of the ignition coil and the primary side resistance of the ignition coil.

The rate of the ignition coil energizing time with respect to an ignition period (hereunder referred to as "a closed-circuit rate") alters depending upon the engine speed.

Further, in order to ensure a time required for a spark discharge, it is necessary to set the maximum value of the closed-circuit rate (the maximum closed-circuit rate) if the closed-circuit rate is large. Therefore, it is necessary to control the energizing time of the ignition coil so as to produce a desired interrupting current against the above-described variation and to also ensure a discharge time by setting the maximum closed-circuit rate.

An ignition control system for controlling the energizing timing of an ignition coil so that the period that the primary current of the ignition coil reaches a predetermined value becomes a predetermined rate of the ignition period of an internal combustion engine and that a constant closed-circuit rate is obtained at the large closed-circuit rate time has been proposed as disclosed, for example, in Japanese Patent Laid-Open No. 40141/1978 as a prior art capable of controlling the energizing time of the ignition coil as described above.

In the abovementioned ignition control system, it is necessary to attain a long energizing time of the ignition coil so as to produce an energy necessary to ignite in high speed rotation range of the engine in case that a battery voltage is low or the primary side inductance of the ignition coil is large, and the maximum closed-circuit rate is set to a relatively high value.

Since the closed-circuit rate reaches the maximum value in the intermediate speed rotation of the engine in the above ignition control system in this case, the conventional control system in which the closed-circuit rate is set to the large predetermined maximum value has such disadvantages that the igniter and the ignition coil are overheated.

If the battery voltage becomes high due to the above set of the closed-circuit rate, the control system has another disadvantage that the ignition energy generated in the high speed rotation of the engine becomes excessive for the requirement.

SUMMARY OF THE INVENTION

An object of this invention is, therefore, to provide an ignition control system for an internal combustion engine capable of eliminating the above-mentioned disadvantages in the prior art and controlling a period that the primary current of an ignition coil reaches a predetermined value to a predetermined period and preventing an igniter and the ignition coil from being overheated and an excessive energy from being discharged.

In order to achieve the above and other objects, an ignition control system for an internal combustion engine according to the present invention comprises:

first means for generating a signal synchronized with an ignition timing of the engine;

second means for determining the maximum energizing time of an ignition coil to vary the maximum energizing time by the output signal of the first means;

third means for detecting the energizing current of the ignition coil to determine the energizing time of the ignition coil so that the period that the energizing current reaches a predetermined value becomes a predetermined value; and switching means for energizing or interrupting the ignition coil according to the signals of the second and the third means.

BRIEF DESCRIPTION OF THE DRAWINGS

The above objects and features of the present invention will be more clearly understood by the following detailed description of preferred embodiments in conjunction with the accompanying drawings in which.

DESCRIPTION OF THE PREFERRED EMBODIMENTS

Figure 1:
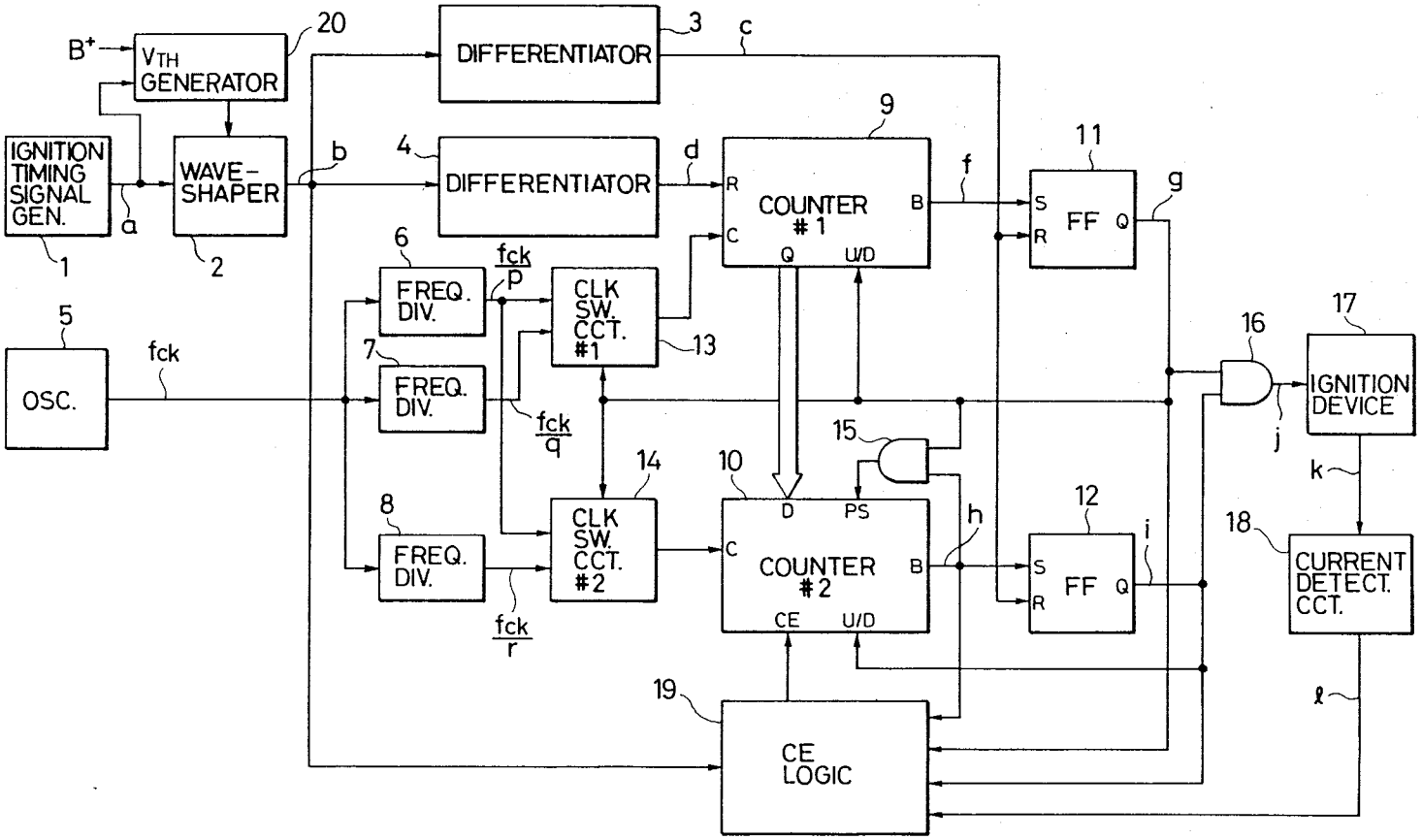
FIG. 1 is a block diagram showing the construction of an embodiment of an ignition control system for an internal combustion engine according to the present invention.

Referring to FIG. 1, an embodiment of the invention comprises an ignition timing signal generator 1 for generating a signal synchronized with the ignition timing of an internal combustion engine, such as a signal generator contained in a distributor, not shown. A waveform shaper circuit 2 is connected to the output of the generator 1 to shape the output signal of the generator 1 in a rectangular shape.

Differentiator circuits 3 and 4 are connected to the output terminal of the waveform shaper circuit 2. The differentiator 3 outputs a pulse at the trailing edge of the rectangular wave corresponding to the ignition timing of the output signal of the waveform shaper 2, and the differentiator 4 outputs a pulse at the leading edge of the rectangular wave of the output of the waveform shaper 2.

An oscillator 5 generates a clock pulse of a frequency $f_{ck}$. The output of the oscillator 5 is applied to frequency dividers 6 to 8. The frequency dividers 6 to 8 divide the clock pulse from the oscillator 5 by predetermined frequency dividing rates 1/p, 1/q and 1/r, respectively.

The control system comprises a first up-down counter (hereunder referred to as "a first counter") 9 having input terminals of a reset terminal R, a clock terminal C and an up-down switching terminal U/D, and output terminals of a terminal Q for outputting a counted value and a terminal B for outputting a borrow signal representing that the counted value is zero at down-count mode time.

A second up-down counter (hereunder referred to as "a second counter") 10 has input terminals of a clock terminal C, a count enable terminal (hereunder referred to as "a CE terminal") for determining whether or not the counting is enabled, an up-down switching terminal U/D, a data input terminal D and a preset terminal PS for setting the value inputted to the a data input terminal D, and a terminal B for outputting a borrow signal, and the data input terminal D is connected to the terminal Q of the first counter 9.

Flip-flops (hereunder referred to as "an FF") 11 and 12 each has input terminals of a set terminal S and a reset terminal R, and an output terminal Q.

The set terminal S of the FF 11 is connected to the terminal B of the first counter 9, and the reset terminal R is connected to the output terminal of the differentiator 3.

The set terminal S of the FF 12 is connected to the terminal B of the second counter 10, and the reset terminal R is connected to the output terminal of the differentiator 3.

A first clock switching circuit 13 has three input terminals, connected to the output terminal of the frequency divider 6, the output terminal of the frequency divider 7 and the output terminal Q of the FF 11, respectively, and an output terminal, connected to the clock terminal C of the first counter. The clock pulses outputted from the frequency dividers 6 and 7 are switched by the output signal of the FF 11, and inputted to the first counter 9.

The first clock switching circuit 13 is set to output the clock pulse $f_{ck}/p$ of the frequency divider 6 when the output of the FF 11 is "H", and to output the clock pulse $f_{ck}/q$ of the frequency divider 7 when the output of the FF 11 is "L".

A second clock switching circuit 14 has three input terminals, connected to the output terminal of the frequency divider 6, the output terminal of the frequency divider 8 and the output terminal Q of the FF 11, respectively, and an output terminal, connected to the clock terminal C of the second counter 10. The clock pulses outputted from the frequency dividers 6 and 8 are switched by the output signal of the FF 11, and inputted to the second counter 10.

The second clock switching circuit 14 is set to output the clock pulse $f_{ck}/p$ of the frequency divider 6 when the output of the FF 11 is "H" and the clock pulse $f_{ck}/r$ of the frequency divider 8 when the output of the FF 11 is "L".

The inputs of an AND gate 15 having two input terminals are connected to the output terminal Q of the FF 11 and the terminal B of the second counter 10, and the output thereof is connected to the preset terminal PS of the second counter 10.

The inputs of an AND gate 1 having two input terminals are connected to the output terminal Q of the FF 11 and the output terminal Q of the FF 12, and the output thereof is connected to an igniter 17.

The igniter 17 has a switching circuit for energizing the primary side winding of the ignition coil when the output signal (an ignition signal) of the AND gate 16 becomes "H" and then interrupting the primary current of the ignition coil when the ignition signal becomes "L".

A current detector circuit 18 outputs a signal to a count enable logic circuit 19 (hereunder referred to as "a CE logic circuit") while the current flowed to the primary side winding of the ignition coil reaches a predetermined value.

The CE logic circuit 19 has a plurality of input terminals, connected to the output of the waveform shaper 2, the terminal B of the second counter 10, the output terminal Q of the FF 11, the output terminal Q of the FF 12 and the output terminal of the current detector 18, an output connected to the CE terminal of the second counter 10, and is composed of logic circuit group for executing a logic operation to be described in more detail.

A threshold voltage generator circuit (hereunder referred to as "a $V_{TH}$ generator") 20 has imputs connected to the ignition timing signal generator 1 and the positive terminal $B_+$ of a battery, respectively, and an output connected to the waveform shaper 2.

Figure 2:
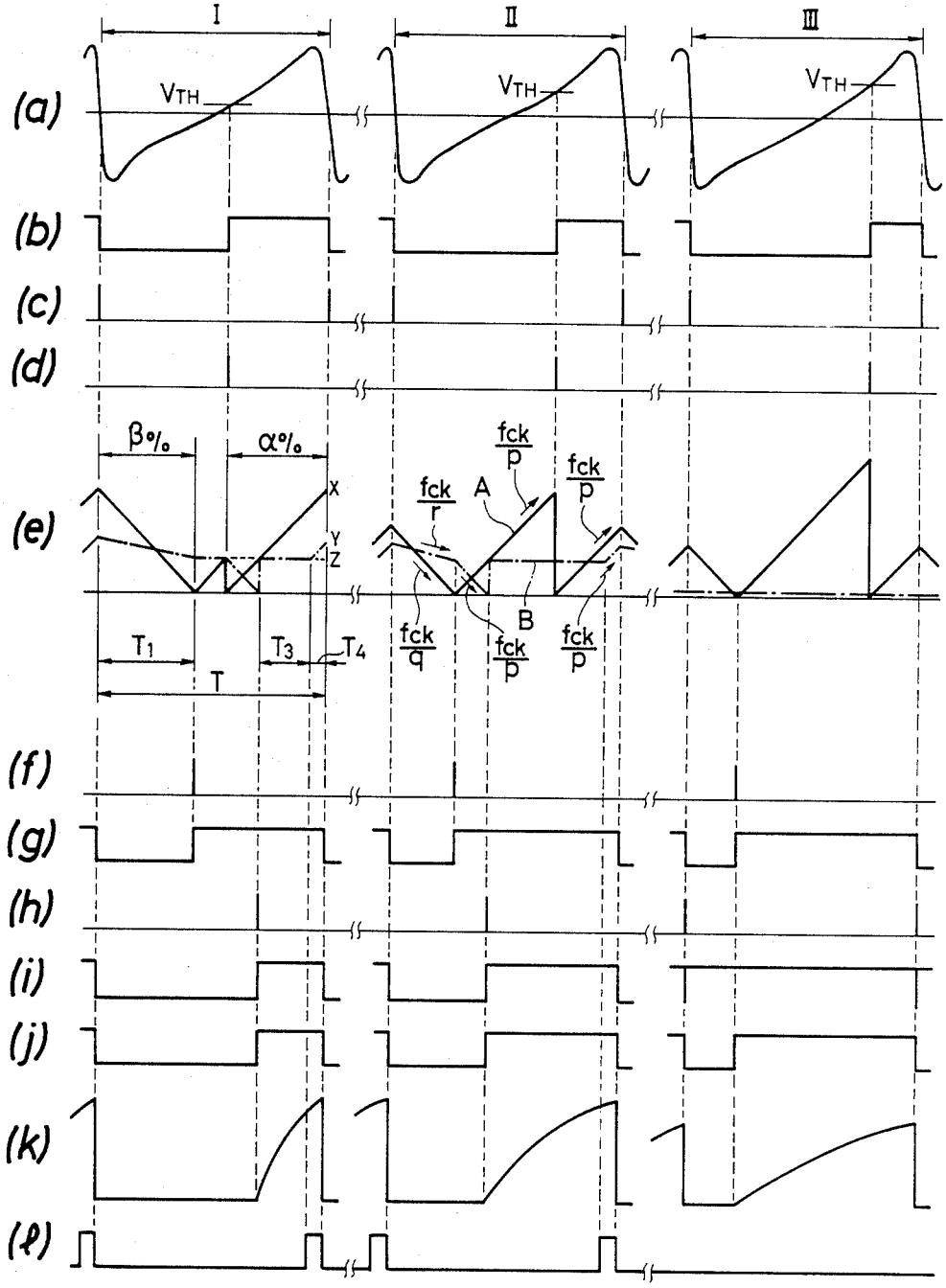
FIGS. 2(*a*)–2(*l*) are time charts for describing the operation of the embodiment in FIG. 1.

The operation of the embodiment of the ignition control system thus constructed will be described in detail with reference to the time charts of FIGS. 2(*a*) to 2(*l*), illustrating the waveforms at points a to l in FIG. 1. FIG. 2(*a*) shows the output signal waveform of the ignition timing signal generator 1.

FIG. 2(*b*) shows a rectangular wave signal produced by shaping the waveform in FIG. 2(*a*) by the waveform shaper 2, in which the falling time point of the rectangular wave is used as an ignition timing.

The waveform shaper 2 uses the threshold voltage (hereunder referred to as "$V_{TH}$") outputted from the $V_{TH}$generator 20 when the input signal thereof rises and a zero crossing point at the input signal falling time as threshold levels.

FIGS. 2(*c*) and 2(*d*) show the output pulses of the differentiators 3 and 4, respectively, outputted at the falling and rising edges of the rectangular wave in FIG. 2(*b*).

FIG. 2(*e*) shows the waveforms representing the counted contents of the first and the second counters 9 and 10, in which a solid line section A represents the waveform of the counted content of the first counter 9, and a dotted chain line B represents the waveform of the counted content of the second counter 10.

FIG. 2(*f*) shows the output signal (borrow signal) of the terminal B of the first counter 9, and FIG. 2(*g*) shows the output waveform of the output terminal Q of the FF 11.

FIG. 2(*h*) shows the borrow signal of the second counter 10, and FIG. 2 (*i*) shows the output waveform of the output terminal Q of the FF 12.

FIG. 2(*j*) shows the waveform of the output signal (ignition signal) of the AND gate 16, FIG. 2(*k*) shows the waveform of the primary current of the ignition coil, and FIG. 2(*l*) shows the output signal waveform of the current detector 18.

The FF 11 is reset by the output pulse (FIG. 2(*c*)) of the differentiator 3 at the ignition timing (at the falling time of the rectangular wave in FIG. 2(*b*)), and the output terminal Q of the FF 11 becomes "L" as designated in FIG. 2(*g*). Therefore, the first counter 9 becomes a down counting mode, and the clock pulse $f_{ck}/q$ of the frequency divider 7 is outputted to the output of the first clock switching circuit 13.

As a result, the first counter 9 down-counts the clock pulse $f_{ck}/q$ from the ignition timing as shown in FIG. 2(*e*).

When the counted content of the first counter 9 becomes zero, a borrow signal is outputted from the terminal B of the first counter 9 as shown in FIG. 2(*f*) to invert the output of the output terminal Q of the FF 1 from "L" to "H" as shown in FIG. 2(*g*).

Thus, the first counter 9 becomes the up counting mode, and the clock pulse $f_{ck}/p$ of the frequency divider 6 is outputted to the output of the first clock switching circuit 13.

As a consequence, the first counter 9 up-counts the clock pulse $f_{ck}/p$ as shown in FIG. 2(*e*).

When the pulse in FIG. 2(*d*) is then outputted from the differentiator 4 at the rising time point of the rectangular wave (in FIG. 2(*b*)), the first counter 9 is reset to the zero counted value by the pulse, and again up-counts the clock pulse $f_{ck}/p$ to the next ignition timing.

Therefore, the counted value of the first counter 9 repeats to up-count in synchronization with the rectangular wave (in FIG. 2(*b*) as shown by the solid line A in FIG. 2(*e*).

Before the operation of the second counter 10 is described, the logic operation of the CE logic circuit 19 is designated in the following Table 1.

TABLE 1

| | Input | | | | | |
|---|---|---|---|---|---|---|
| Mode | Output of waveform shaper | Output of FF12 | Output of FF11 | Current detection signal | # Remarks | Count enable output |
| A | * | * | L | * | * | H |
| B | * | * | * | H | * | H |
| C | * | H | H | L | * | L |
| D | L | * | H | L | Yes | L |
| E | * | L | * | * | No | H |
| F | H | L | * | * | Yes | H |

In this table 1, the mark "*" means no question, and the mark "#" means to request whether or not the borrow signal of the second counter 10 at the previous ignition timing falls "H" of the output signal of the waveform shaper 2.

The table 1 shows the outputs of the CE logic circuit 19 for the signal modes inputted thereto in a logic table according to modes A to F. The "H" in the count enable output mode represents counting enable, and the "L" represents counting disable.

The FF 12 is reset by the output pulse (in FIG. 2(*c*) of the differentiator 3 at the ignition timing (at the falling time of the rectangular wave of FIG. 2(*b*)), and the output terminal Q of the FF 12 becomes "L" as in FIG. 2(*i*). Therefore, the second counter 10 becomes down counting mode.

The second clock switching circuit 14 outputs the clock pulse $f_{ck}/r$ of the frequency divider 8 in the "L" output zone (the "L" zone in FIG. 2(*g*)) of the FF 11. In this case, the CE logic circuit 19 outputs an "H" signal since the input signal condition corresponds to the A mode in Table 1.

Therefore, the second counter 10 down-counts the clock pulse $f_{ck}/r$ in the "L" zone in FIG. 2(*g*).

When the output of the FF 11 is then inverted from "L" to "H", the output of the second clock switching circuit 14 is switched to the clock pulse $f_{ck}/p$ outputted from the frequency divider 6.

If the borrow signal output timing of the second counter 10 during the previous ignition period falls in the "L" zone of the rectangular wave (in FIG. 2(*b*)), the CE logic circuit 19 outputs an "H" signal since the input signal condition corresponds to the E mode in Table 1.

Therefore, the second counter 10 down-counts the clock pulse $f_{ck}/p$ as shown by a dotted chain line B of the (II) section of FIG. 2(*e*). When the second counter 10 down-counts to the zero, the borrow signal (in FIG. 2(*h*)) is outputted from the terminal B of the second counter 10.

This borrow signal is inputted through the AND gate 15 to the preset terminal PS of the second counter 10 to preset the counted value of the first counter 9 to the second counter 10.

The output of the FF 12 is switched by the borrow signal from "L" to "H" as shown in FIG. 2(*i*), and the second counter 10 is switched to the up counting mode.

The output of the AND gate 16 is switched from "L" to "H" as shown in FIG. 2(*i*) at this time, and the igniter 17 is energized in the ignition coil. The output of the AND gate 16 is inverted to "L" at the ignition timing to interrupt the primary current of the ignition coil, thereby to ignite the engine.

The current detector 18 outputs the current detection signal as shown in FIG. 2(*l*) to the CE logic circuit 19 while the primary current reaches the predetermined value. Since the input signal condition corresponds to the C mode in Table 1, the CE logic circuit 19 outputs an "L" signal during the zone that the current detection signal is not outputted in the output zone of "H" of the FF 12 ("H" zone of FIG. 2(*i*)), and since the input signal condition corresponds to the B mode in table 1, the CE logic circuit 19 outputs an "H" signal during the zone that the current detection signal is outputted.

Thus, the second counter 10 does not count in the zone that the current detection signal is not outputted as shown in FIG. 2(*c*) during the "H" outputting zone (ignition coil energizing zone) of the FF 12, holds the above-mentioned preset counted value, and up-counts the clock pulse $f_{ck}/p$ during the zone that the current detection signal is outputted.

As described above, the second counter 10 up-counts as designated by a dotted broken line in the (I) section of FIG. 2(*e*).

The case that the borrow signal output timing of the second counter 10 falls in the "H" zone of the rectangular wave in FIG. 2(*b*) in the previous ignition timing will be described with reference to the operating waveform in the (I) section of FIG. 2.

When the FF 11 is set to "L" zone, the second counter 10 down-counts the clock pulse $f_{ck}/r$ similarly to the above description.

When the output of the FF 11 is inverted to "H", the CE logic circuit 19 outputs an "L" signal this time since the input signal condition corresponds to the D mode in Table 1.

Therefore, the second counter 10 does not count as designated by the dotted broken line of the (I) section of FIG. 2(*e*), but holds the counted value at the switching time from "L" to "H" of the output of the F 12. When the output signal (in FIG. 2(*b*)) of the waveform shaper 2 becomes "H", the CE logic circuit 19 outputs an "H" signal since the output signal condition corresponds to F mode in Table 1.

Therefore, the second counter 10 down-counts the clock pulse $f_{ck}/p$.

The operation after the counted content of the second counter 10 becomes zero is similar to the operation as described above.

As described above, the energization starting time is controlled by dividing into the case that the closed-circuit rate is relatively large like the intermediate rotation time of the engine and the energization starting time (the borrow signal outputting time of the second counter 10) falls the "L" zone of the output signal (in FIG. 2(*b*) of the waveform shaper 2 (in the (II) section of FIG. 2), and the case that the closed-circuit rate is small like the low speed rotation time of the engine and the energization starting time falls in the "H" zone of the output signal of the waveform shaper 2 (in the (I) section of FIG. 2).

The control of the energizing time of the ignition coil will be described in detail. As shown in the (I) section of FIG. 2, the time $T_3$ until the primary current of the ignition coil reaches a predetermined time is constant in the steady state that the ignition period T, the battery voltage and the primary current of the ignition coil are constant, and the counted content X of the first counter 9, the counted contents Y and Z of the second counter 10 become constant.

Assume that the rate of the case that the rectangular wave (in FIG. 2(*b*) outputted from the waveform shaper 2 is "H" with respect to the ignition period is $\alpha\%$, the rate $\beta\%$ of the "L" zone of the FF 11 with respect to the ignition period becomes:

$$\beta = q/p \cdot \alpha$$

Then, the following three equations are attained.

$$Y = Z + f_{ck}/r \cdot T_1$$

where $T_1$ is the "L" output time of the FF 11, $$Y = Z + f_{ck}/p \cdot T_4$$

where $T_4$ is the current detection signal outputting time, $$T_1 = \beta/100 \cdot T$$

From the above three equations, the $T_4$ can be obtained as below.

$$T_4 = q/n \cdot \alpha/100 \cdot T$$

Therefore, it is understood that the rate of the time $T_4$that the current detection signal is "H" with respect to the ignition period T becomes the value of $q/r \cdot \alpha\%$. This is similar to the case of the (II) section of FIG. 2.

As described above, the period that the primary current of the ignition coil reaches the predetermined value can be controlled to a predetermined rate of the ignition period.

When the closed-circuit rate in the high speed rotation time of the engine increases, the energizing time of the ignition coil is limited by the output signal (FIG. 2(*g*)) of the FF 11 through the AND gate 16, and the energizing time does not become longer than the limited value.

When the engine speed rises to shorten the ignition period, the interrupting current of the ignition coil decreases as designated in the (III) section of FIG. 2(*k*), and the current detection signal (in FIG. 2(*l*) is not outputted. Since the second counter 10 thus cannot up-count, the counted content becomes zero in all zone.

Therefore, in this case, the closed-circuit rate becomes the maximum closed-circuit rate $r$ $(=100-\beta=100-q/p \cdot \alpha)\%$ determined by the output signal (in FIG. 2(*g*) of the FF 11.

Figure 3:
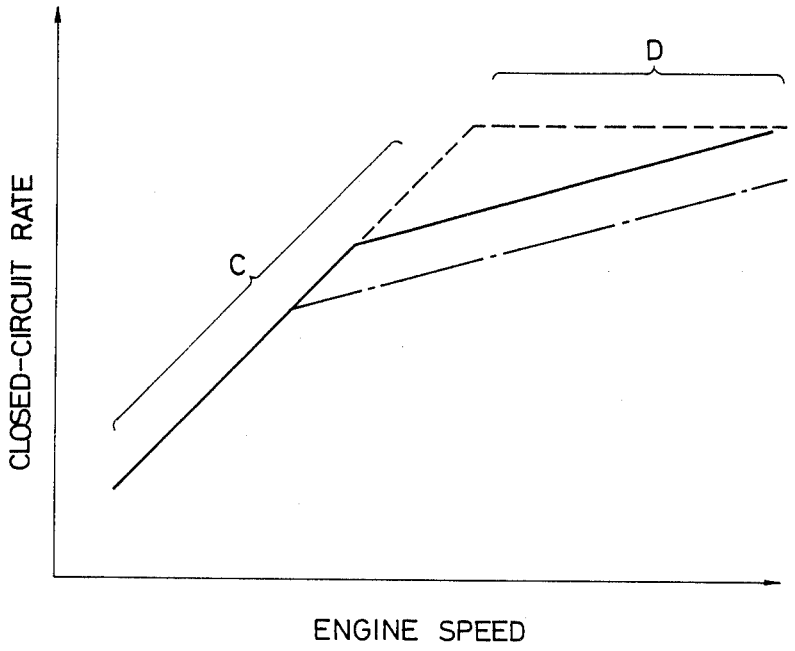
FIG. 3 is a closed-circuit rate characteristic diagram of the ignition timing control system of the engine.

The closed-circuit rate characteristic with respect to the engine speed of controlling the energizing timing described above is shown in FIG. 3. In FIG. 3, the curve in the section C exhibits the control characteristic described with respect to the (I) and (II) sections of FIG. 2, and the second D illustrates the characteristic of the maximum closed-circuit rate described with respect to the (III) section of FIG. 2.

Assume that the $\alpha$ is fixed to a constant %, the maximum closed-circuit rate r becomes constant %, and the closed-circuit rate characteristic becomes as designated by a broken line in FIG. 3.

In this characteristic case, the closed-circuit rate becomes maximum even in the intermediate rotation speed zone of the engine to be unpreferable in view of an overheat.

Therefore, the maximum closed-circuit rate r characteristic can be altered by varying the $\alpha$ threshold level of the waveform shaper 2.

The $V_{TH}$ generator 20 inputs the output signal of the ignition timing signal generator 1, calculates the ignition period and generates the $V_{TH}$ that the voltage rises with respect to the engine speed by calculating the function regarding the engine speed.

The waveform shaper 2 uses the $V_{TH}$ as the the threshold level at the input signal rising time as shown in FIG. 2(*a*), and shapes the output signal of the generator 1.

Thus, since the output signal $V_{TH}$ of the waveform shape 2 rises in the (I), (II) and (III) sections as the engine speed is accelerated as shown in FIG. 2(*a*), the rate ($\alpha\%$) of the "H" portion of the rectangular wave decreases. The maximum closed-circuit rate r determined by the $\alpha\%$ increases with respect to the engine speed to become the characteristic as designated by a solid line of the section D in FIG. 3.

Therefore, the maximum closed-circuit rate characteristic that the heat generation is small in the intermediate speed rotation and the energy is large in the high speed rotation can be achieved.

The $V_{TH}$ generator 20 inputs the battery voltage B+, and is set to output the low $V_{TH}$ when the battery voltage is low and the high $V_{TH}$ when the battery voltage is high.

Thus, the maximum closed-circuit rate characteristic becomes small as designated by a dotted broken line in FIG. 3 when the battery voltage is high to suppress the discharge of an excessive energy.

In the embodiment described above, the ignition timing signal generator which outputs an alternating signal as shown in FIG. 2(*a*) has been employed. However, the present invention is not limited to the particular embodiment. For instances, an ignition timing controller for determining the ignition timing of the engine by a microprocessor may be employed as an ignition timing signal generator to use a rectangular wave signal outputted from the ignition timing controller as the rectangular wave in FIG. 2(*b*).

In this case, the $V_{TH}$ generator is not used, but the rectangular wave signal having a width responsive to the engine speed and the battery voltage may be inputted by calculating in the ignition timing controller.

In the embodiment described above, a digital circuit such as the up-down counter has beem employed. However, the invention is not limited to the particular embodiment. For example, the up-down counter is replaced by an integrator and the clock switching circuit is exchanged by an integrating time constant switching circuit, thereby performing an analog circuit.

In the embodiment described above, the $V_{TH}$ is varied according to the engine speed. However, the invention is not limited to this. For example, the $V_{TH}$ may be altered by a signal representing the load state of the engine.

As described hereinbefore, according to the present invention, the maximum closed-circuit rate of the ignition coil is altered according to the operating state of the engine and the battery voltage. Consequently, the period that the primary current of the ignition coil reaches the predetermined value can be controlled to a predetermined period, and the heats of the ignition coil and the igniter can be suppressed, thereby preventing the ignition energy from being excessively discharged.

What is claimed is:

1. An ignition control system for an internal combustion engine, comprising:

(a) first means for generating a signal synchronized with an ignition timing of the engine;

(b) second means for determining the maximum energizing time of an ignition coil to vary the maximum energizing time in accordance with the output signal of said first means, said second means including waveform shaper means, variable means for varying the duty cycle of an output signal of said waveform shaper means, and operation means responsive to said duty cycle of said output signal of said waveform shaper means for determining the maximum circuit closing rate of said ignition coil;

(c) third means for detecting the energizing current of the ignition coil to determine the energizing time of the ignition coil so that the period of the energizing current reaches a predetermined value; and (d) switching means for energizing or interrupting the ignition coil in accordance with output signals of said second means and said third means.

2. An ignition control system as claimed in claim 1, wherein said variable means of said second means can vary the maximum energizing time according to the oeprating state of the engine.

3. An ignition control system as claimed in claim 1, wherein said variable means of said second means can vary the maximum energizing time according to the power source voltage.

4. An ignition control system as claimed in claim 1, wherein said waveform shaper means is connected at an input thereof to said first means for shaping the output of said first means in a rectangular shape, and wherein said operation means includes differentiating means connected at an input thereof to said waveform shaper means output for outputting a pulse at the trailing edge of the rectangular wave corresponding to the ignition timing of the output signal of said waveform shaper means, oscillator means for generating a clock pulse of a predetermined frequency, and up-down counter means connected at inputs thereof to the output of said differentiator means and the output of said oscillator means for outputting a counted value of the input pulse and a borrow signal representing that the counted value is zero at down-counting mode time.

5. An ignition control system as claimed in claim 4, wherein said operation means further includes clock switching means connected at inputs thereof to the output of said oscillator means and the output of said counter means for outputting the clock pulse from said oscillator means to the input of said counter means.

6. An ignition control system as claimed in claim 5, wherein said operation means further includes second clock switching circuit means connected at inputs thereof to the output of said oscillator means and the output of said first counter for outputting the clock pulse from said oscillator means, and second counter means connected at the inputs thereof to the output of said oscillator means and the output of said first counter means for outputting the clock pulse from said oscillator means to the igniter.

7. An ignition control system as claimed in claim 1, wherein said third means further includes current detector means connected at an input thereof to said igniter for outputting a signal during a period that the current flowed to the primary side of said igniter reaches a predetermined value, and CE logic means connected at inputs thereof to the output of said current detector means and the output of said waveform shaper means, the second counter means for outputting output pulses at the falling and rising edges of the rectangular wave of said counter means.

* * * * *